US005695295A

United States Patent [19]

Ayele et al.

[11] Patent Number: 5,695,295

[45] Date of Patent: Dec. 9, 1997

[54] RESTRAINING DEVICE FOR BINDER COVER MEMBERS

[75] Inventors: Fikre Ayele, 1680 York Av. #3G, New York, N.Y. 10128; Richard Roig, Paterson, N.J.

[73] Assignee: Fikre Ayele, New York, N.Y.

[21] Appl. No.: 241,170

[22] Filed: May 10, 1994

[51] Int. Cl.[6] ..... B42F 13/00

[52] U.S. Cl. ..... 402/80 R; 402/4; 281/37; 281/51

[58] Field of Search ..... 281/15.1, 20, 21.1, 281/28, 29, 37, 51; 402/4, 70, 73, 74, 80 R

[56] References Cited

U.S. PATENT DOCUMENTS

| | | | |
|---|---|---|---|
| 501,751 | 7/1893 | Waring . | |
| 717,842 | 1/1903 | Grimes . | |
| 871,610 | 11/1907 | Nash | 281/20 |
| 3,196,564 | 7/1965 | Boedeker | 402/79 X |
| 3,248,814 | 5/1966 | Zwolinski | 402/79 X |
| 4,524,991 | 6/1985 | Thomas | 281/20 |
| 4,531,764 | 7/1985 | Chang | 402/80 R |
| 4,569,613 | 2/1986 | Thomas | 402/80 R |
| 4,744,689 | 5/1988 | Sternberg | 402/502 X |
| 4,932,679 | 6/1990 | Mayer et al. | 281/18 |
| 4,997,207 | 3/1991 | Feidman | 402/502 X |
| 5,002,416 | 3/1991 | Serzen | 402/74 |
| 5,067,748 | 11/1991 | Wennquest | 402/73 X |
| 5,069,567 | 12/1991 | Fink et al. | 402/73 X |
| 5,108,130 | 4/1992 | Hansen | 281/20 X |
| 5,267,804 | 12/1993 | Baumgarten | 402/80 R |

FOREIGN PATENT DOCUMENTS

| | | | |
|---|---|---|---|
| 2513942 | 4/1983 | France | 281/18 |
| 9002226 | 6/1983 | Germany | 402/502 |

*Primary Examiner*—Willmon Fridie
*Attorney, Agent, or Firm*—Robert W. J. Usher

[57] ABSTRACT

A restraining device for a loose leaf binder comprises restraining members each having a substantially rigid spacing portion with cover mounting and coupling portions at respective opposite ends. The cover mounting portions extend perpendicularly from respective spacing portions and comprise respective clips for gripping respective free edge portions of respective cover members releasably to mount the restraining members thereon with the respective spacing portions extending perpendicularly from their respective cover members across the binder towards each other. The coupling portions have complementary latching means inter-engageable with a snap action by closing movement of the cover members so that the restraining members bridge the free edges of the cover members maintaining them spaced apart in parallel relation irrespective of the height of papers stacked therebetween and are releasable by application of finger pressure.

9 Claims, 1 Drawing Sheet

FIG. 1
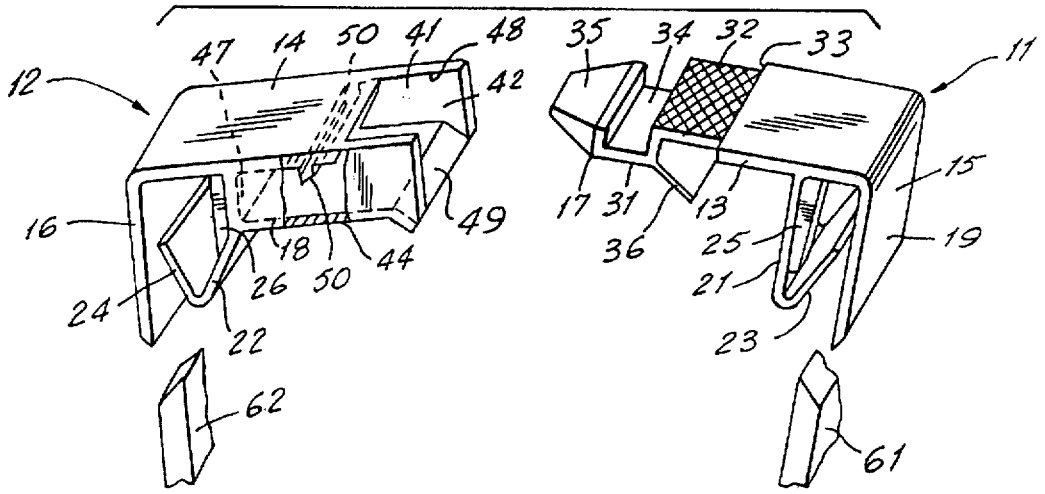
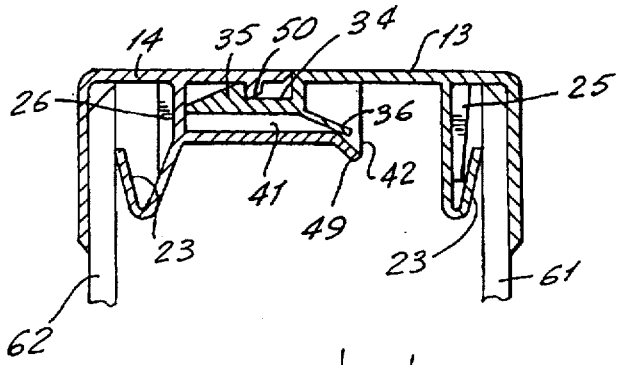
FIG. 2
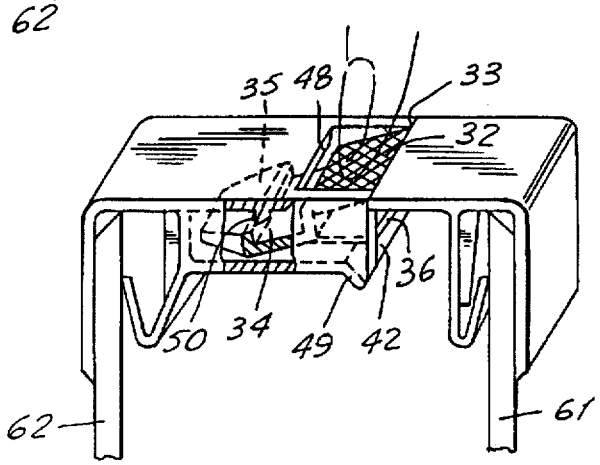
FIG. 3
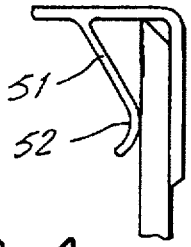
FIG. 4

RESTRAINING DEVICE FOR BINDER COVER MEMBERS

FIELD OF THE INVENTION

The invention relates to a restraining device for maintaining the cover members of a loose leaf binder spaced apart in parallel relation.

BACKGROUND OF THE INVENTION

The problems associated with maintaining the cover members of a loose leaf binder spaced apart in parallel relation are well recognized and there have been many prior attempts over many years to provide a satisfactory solution.

For example, U.S. Pat. No. 4,531,764 issued to Chang in 1985 teaches mounting an adjustable closed loop strip inside a cover to provide a spacer. However, the strip must be adjusted with any significant change in the number of papers in the file which procedure can be inconvenient and time consuming. Furthermore, the strip is intended to be permanently adhered to the cover preventing transfer and reuse on other files when the file is completely full and the spacer is not needed. In addition, the strip does not provide a closure member for the file.

In another approach, taught by U.S. Pat. No. 4,744,689, issued to Sternberg in 1988, a spacing block is mounted permanently along a free edge of one cover and hook and eye fasteners releasably secure the other cover to the top of the block. Again transfer from a completely full file to another would not seem to be possible, while a block mounting process would seem to involve an undesirably time consuming manufacturing process and the presence of block may add significantly to the weight of the binder.

Additionally, hook and loop fasteners can, in practice, be relatively difficult and time consuming to open.

In other approaches, taught by U.S. Pat. Nos. 4,569,613 and 4,524,991, issued to Thomas in 1984 and 1983, respectively, a channel section restraining member has clips releasably receiving the entire free edges of the covers along the open side remote from the spine. However, the restraining member must be completely removed from the file each time to open the file to add papers while it can be relatively difficult to align both the entire free edges with the respective clips for forcible receipt therein, particularly if the file is relatively worn and the hinged connection to the spine is weak so that the covers are not precisely aligned with each other or, if the file is slightly overfull, requiring the cover members to be manually forced together.

In an attempt to overcome at least some of the disadvantages of the above-mentioned teachings listed therein, U.S. Pat. No. 4,997,207 issued to Feldman in 1992 specifically directs that any such restraining member be permanently attached to a notebook cover, which is clearly disadvantageous as, when a binder is completely filled, the restraining member may no longer be needed and removal and mounting on the next unfilled or only partially filled binder is desirable.

In addition, the binder relies on a particular construction of detent latching mechanism which requires that the restraining member be depressed into the file along the entire length thereof to fasten and release the latching mechanism which can require difficult manipulation particularly as some papers may be improperly filed obstructing the inner movement of the restraining member or when the file is slightly overfull. In addition, there would appear to be a risk of the hinge portion weakening in resiliency in use of the binder for an extended period.

In other approaches requiring permanent attachment of spacing members, U.S. Pat. No. 5,002,416 issued to Serzen in 1991, teaches post-form spacing portions which can be broken to required height and are preferably attached by adhesive to upstand from the inside surface of one cover member but do not secure the binder in closed condition; 501,751 issued to Waring in 1893 teaches loop-form restraining members located to upstand around the entire periphery of the file opening while 717,842 to Grimes teaches a height adjustable post screw mounted into a cover member requiring an undesirably massive construction, complex and expensive manufacture and relatively time consuming to assemble. The upstanding spacing or restraining members taught by Serzen and Grimes may also impede access to file papers during file use, while the ring catch taught by Grimes may prove relatively difficult to manipulate.

Still other approaches are described in U.S. Pat. No. 5,267,804 filed September 1991 and issued December 1993 to Baumgarten; U.S. Pat. No. 5,069,567 to Fink et al; French 252942 published 1983; German 9002226 published 1983; 5067748 issued 1991 to Wernques; U.S. Pat. No. 4,932,679 issued 1990 to Mayer.

SUMMARY OF THE INVENTION

An object of the invention is to provide a restraining device for a binder or loose leaf file for maintaining the cover members spaced apart in parallel relation even when the binder is not completely filled and which can quickly and easily be releasably secured or retrofitted to a conventional file binder when desired without any modification thereof being required, and can be moved to latch the binder in closed condition simply by closing the cover members together, even when the binder is slightly overfull.

A restraining device for a loose leaf binder of the type having a pair of substantially rigid cover members hingedly joined to respective opposite, parallel, longitudinal edges of a substantially rigid spine for receiving between them stacked papers, the restraining device comprising restraining members each comprising a substantially rigid spacing portion having a cover mounting portion and a coupling portion at respective opposite ends, the cover mounting portions extending perpendicularly from respective spacing portions and comprising respective clips for gripping respective free edge portions of respective cover members releasably to mount the restraining members thereon with the respective spacing portions extending perpendicularly from their respective cover members across the binder towards each other, the coupling portions having complementary latching means inter engageable with a snap action by closing movement of the cover members so that the restraining members bridge the free edges of the cover members maintaining them spaced apart in parallel relation irrespective of papers stacked therein and are releasable by application of finger pressure to a restraining member.

Thus, the binder can be closed and latched securely with the cover members maintained parallel, simply by closing the cover members towards each other to bring the latching means automatically into latching engagement, irrespective of the height of the paper stack between the cover members. Even if the file is slightly overfull, the cover members may simply be forcibly closed together to obtain the latched condition.

Clearly, the invention provides the distinct practical advantage of ease of handling in daily use.

Preferably, release is obtained by applying finger pressure to one of the members in the direction of the spine enabling release by using only one hand, if necessary, with the spine resting on a support such as table.

More specifically one coupling portion comprises a socket having a catch therein and the other coupling portion comprises a resiliently flexible tongue with a tapering latching head engageable with the catch in a snap action by entry of the latching head into the socket.

Advantageously, a biasing spring finger extends rearward from the tongue and is resiliently deformed by engagement with a mouth of the socket on entry of the latching head thereby to bias the latching head in latching engagement with the catch.

The socket has a latching head admitting mouth at one axial end thereof opening towards the free end and extending axially rearward on only one lateral side of the socket to provide an opening for permitting entry of the latching head into the mouth both from an axial and a lateral direction and providing access for a finger to depress the tongue to release the latching means.

Thus, a degree of lateral misalignment in presentation of the restraining members during closure of the binder, arising possibly from deformation at the spine with respective cover members subtending acute and obtuse angles therewith, can be accommodated by entry of the latching head into the socket through the rearward and laterally extending portion of the mouth.

The tongue is of reduced width, providing shoulders on respective opposite sides which abut the socket mouth when the latching head is in latching engagement with the catch to maintain the cover members spaced apart in parallel relation.

The cover mounting portions comprising outer support walls and inner resilient walls which extend away from the respective spacing portions in spaced apart relation to the respective outer walls and have free ends formed with detent retention fingers which extend back towards the respective outer walls so that respective, free ends are located adjacent respective outer walls. Anti-overstress ribs outstand from the inner walls behind the respective fingers to prevent overstress of the retention fingers either during mounting on the cover members or during depression of the tongue for unlatching.

BRIEF DESCRIPTION OF THE DRAWINGS

Specific embodiments of the invention will now be described by way of example only, with reference to accompanying drawings in which:

FIG. 1 is an exploded perspective view, partly cut away, of restraining members aligned for mounting on respective cover members of a ring binder;

FIG. 2 is a cross-sectional view of the restraining members shown in FIG. 1 mounted and latched mated on the respective cover members which are closed together;

FIG. 3 is a perspective view, partly cut away, of the mated restraining members during depression of the latching tongue to release the catch; and FIG. 4 is a fragmentary cross-sectional view of a cover mounting portion of an alternative restraining member mounted on a cover member.

DESCRIPTION OF PARTICULAR EMBODIMENTS

As shown in FIGS. 1–3, the restraining device comprises male and female restraining members 11 and 12, respectively, each formed largely by molding from suitable plastic material and comprising spacing portions 13 and 14, respectively, integrally formed at one end with perpendicularly extending cover mounting portions 15 and 16, respectively, the other ends been formed with intermatable coupling portions 17 and 18, respectively.

The cover mounting portions 15 and 16 each form a clip comprising outer support walls 19 and 20, respectively, and inner resilient walls 21 and 22, respectively, which extend away from the respective spacing portions 13 and 14 in spaced apart relation to the respective outer walls and having free ends form with detent retention fingers 23 and 24 which extend back towards the respective outer walls 19 and 20 so that respective, free ends are located adjacent respective outer walls. Inner wall 22 also extends towards outer wall 20. Anti-overstress ribs 25 and 26 outstand from the inner walls behind the respective fingers 23 and 24. The general configuration of the clip portions is somewhat similar to poke in, wire gripping electrical connecting devices.

The coupling portions 17 and 18 of the male and female members 11 and 12 are of somewhat similar construction to a seat belt buckle of an automobile.

The coupling portion 17 of the male member 11 comprises a resiliently flexible tongue 31 of reduced width having a knurled finger engagable surface 32 and extending centrally from the spacing portion 13 providing shoulders 33 on respective opposite sides thereof to one wall of a transverse latching channel 34, the opposite wall of the channel being integral with a tapering latching head 35. A biasing spring finger 36 extends rearward from the lowest part of the latching channel wall away from the spacing portion 13.

The coupling portion 18 of the female member 12 comprises a socket 41 of rectangular cross section having a mouth 42 opening towards the free end and opposite upper and lower side walls 43 and 44, respectively, and a rear wall 47. The upper side wall is rebated at 48 enlarging the socket mouth to afford lateral entry for the latching head and the lower side wall 44 is formed with a flared, entry facilitating lip 49. A ramp-form catch 50 inside the socket, extends transversely across a upper wall 43.

In operation, mounting portions of respective restraining members are aligned with each other, usually centrally of free edges of respective cover members 61 an 62, respectively, at the open end, remote from the spine, of a conventional loose-leaf ring binder, as shown in FIG. 1, and forced thereon with a simple manual pushing action so that the covers enter and are gripped between the respective detent fingers 23 and 24 and the respective supporting walls 19 and 20. Abutment of the respective detent fingers 23 and 24 with respective anti-overstress ribs 25 and 26 prevents strain thereof in the event of unusually thick covers or inaccurate and forceful application. Once installed, edges of the tips of the detent fingers bite into the plastic cover members, which are usually of relatively soft plastics, ensuring firm retention of the restraining members thereon.

The restraining members 11 and 12 are releasably coupled together by a simple file closing action which causes the latching head to enter the socket, flex over the catch and resile behind the catch with a snap action so that the catch is seated in the latching recess. During entry, the spring finger is resiliency deformed by engagement with the flared lip so that the biasing force thereof assists in ensuring retention of the catch in the recess. The shoulders then abut free edges of end walls of the socket. The cumulative dimensions of the two spacing portions are substantially equal to the width of the spine of the ring binder ensuring that the rectangular configuration is maintained with opposite cover members in parallel relation, irrespective of the degree to which papers fill the file.

The flared lip and rebated portion accommodate a degree of misalignment of the restraining members arising from possible misalignment of the cover members (subtending acute and obtuse angles with the spine, respectively) so that coupling may be achieved although the female member may be positioned slightly below the male member. Once the latching head has entered the mouth even via the rebated portion, coupling by closing the cover members together is assured.

Uncoupling is achieved by simply pressing the knurled surface to depress the tongue, with flexure of the biasing arm, removing the latching head from behind the catch, the finger pressure normally being sufficient to also withdraw the tongue from the socket, which action may be aided somewhat by the resiliency of the biasing arm bearing against the flared lip to provide an expulsion force. Whilst it is normally desirable that only the clip portion undergo flexure during unlatching movement, some strain may be transferred to the clip portion where abutment of the respective detent fingers 23 and 24 with respective anti-overstress ribs 25 and 26 prevents overstress strain thereof.

In an alternative embodiment shown in FIG. 4, the inner resilient wall 51 is simply inclined towards the outer walls terminating in a retention foot 52 which may be formed with a tooth or ridge (not shown) to bite into the cover material thereby retaining the restraining member more securely on the cover member.

In another version the coupling portions could be integral with the cover members.

We claim:

1. A restraining device for a loose leaf binder of the type having a pair of substantially rigid cover members hingedly joined to respective opposite, parallel, longitudinal edges of a substantially rigid spine for receiving between them stacked papers, the restraining device comprising restraining members each comprising a substantially rigid spacing portion having a cover mounting portion and a coupling portion at respective opposite ends, the cover mounting portions extending perpendicularly from respective spacing portions and comprising respective clips for gripping respective free edge portions of respective cover members releasably to mount the restraining members thereon with the respective spacing portions extending perpendicularly from their respective cover members across the binder towards each other, the coupling portions having complementary latching means inter engageable with a snap action by closing movement of the cover members so that the restraining members bridge the free edges of the cover members maintaining them spaced apart in parallel relation irrespective of papers stacked therein and are releasable by application of finger pressure to a restraining member.

2. A restraining device according to claim 1 wherein release is obtained by applying finger pressure to one of the members in the direction of the spine enabling release by using only one hand.

3. A restraining device according to claim 2 wherein one coupling portion comprises a socket having a catch therein and the other coupling portion comprises a resiliently flexible tongue with a tapering latching head engageable with the catch in a snap action by entry of the latching head into the socket.

4. A restraining device according to claim 3 wherein a biasing spring finger extends rearward from the tongue and is resiliently deformed by engagement with a mouth of the socket on entry of the latching head thereby to bias the latching head in latching engagement with the catch.

5. A restraining device according to claim 3 wherein the socket has a latching head admitting mouth at one axial end thereof opening towards the free end and extending axially rearward on only one lateral side of the socket to provide an opening for permitting entry of the latching head into the mouth both from an axial and a lateral direction and providing access for a finger to depress the tongue to release the latching means.

6. A restraining device according to claim 3 wherein the tongue is of reduced width, providing shoulders on respective opposite sides which abut the socket mouth when the latching head is in latching engagement with the catch to maintain the cover members spaced apart in parallel relation.

7. A restraining device according to claim 1 wherein the cover mounting portions comprising outer support walls and inner resilient walls which extend away from the respective spacing portions in spaced apart relation to the respective outer walls and have free ends formed with detent retention fingers which extend back towards the respective outer walls so that respective, free ends are located adjacent respective outer walls.

8. A restraining device according to claim 7 wherein anti-overstress ribs outstand from the inner walls behind the respective fingers to prevent overstress of the retention fingers either during mounting on the cover members or during depression of the tongue for unlatching.

9. A restraining device for a loose leaf binder of the type having a pair of substantially rigid cover members hingedly joined to respective opposite, parallel, longitudinal edges of a substantially rigid spine for receiving between them stacked papers, the restraining device comprising restraining members each comprising a substantially rigid spacing portion having a coupling portion at one end, the coupling portions having complementary latching means inter-engageable with a snap action, each spacing portion being attached at another end to a respective cover member with the respective spacing portions extending perpendicularly from the respective cover members across the binder towards each other, the coupling portions being inter-engageable by closing movement of the cover members so that the restraining members bridge the free edges of the cover members maintaining them spaced apart in parallel relation irrespective of papers stacked therein and are releasable by application of finger pressure to a restraining member.

* * * * *